United States Patent [19]

Phillips et al.

[11] Patent Number: 5,010,274

[45] Date of Patent: Apr. 23, 1991

[54] STARTER CIRCUITS FOR DISCHARGE LAMPS

[75] Inventors: Geoffrey J. Phillips, Gilesgate; Kevin F. George, Merstham, both of England

[73] Assignee: Thorn EMI plc, London, England

[21] Appl. No.: 324,510

[22] Filed: Mar. 16, 1989

[30] Foreign Application Priority Data

Mar. 17, 1988 [GB] United Kingdom ..... 8806384

[51] Int. Cl.[5] ..... H05B 41/36

[52] U.S. Cl. ..... 315/101; 315/99; 315/106; 315/290; 315/DIG. 2

[58] Field of Search ..... 315/99, 101, 106, 289, 315/290, DIG. 2

[56] References Cited

U.S. PATENT DOCUMENTS

| | | | |
|---|---|---|---|
| 3,942,070 | 3/1976 | Tomura et al. | 315/99 X |
| 3,978,368 | 8/1976 | Tomura et al. | 315/99 |
| 3,978,369 | 8/1976 | Imaizumi et al. | 315/99 |
| 4,119,887 | 10/1978 | Iyama et al. | 315/99 X |
| 4,165,475 | 8/1979 | Pegg et al. | 315/99 |
| 4,544,863 | 10/1985 | Hashimoto | 315/289 X |
| 4,629,944 | 12/1986 | Maytum et al. | 315/101 X |
| 4,673,844 | 6/1987 | Maytum et al. | 315/101 X |

*Primary Examiner*—Eugene R. LaRoche
*Assistant Examiner*—Do Hyum Yoo
*Attorney, Agent, or Firm*—Fleit, Jacobson, Cohn, Price, Holman & Stern

[57] ABSTRACT

A starter circuit for a discharge lamp includes a current control circuit which initially has a low impedance so as to produce an initial cathode heating current for the lamp. The current control circuit is switched into a high impedance condition by means of a control voltage applied to its gate thereby causing a high voltage striking pulse to be applied across the lamp. A field effect transistor is effective to modify the control voltage to the gate such that the starting circuit is effective to produce a succession of starting pulses across the lamp during each half cycle of a rectified AC supply.

12 Claims, 2 Drawing Sheets

STARTER CIRCUITS FOR DISCHARGE LAMPS

Figure 1:
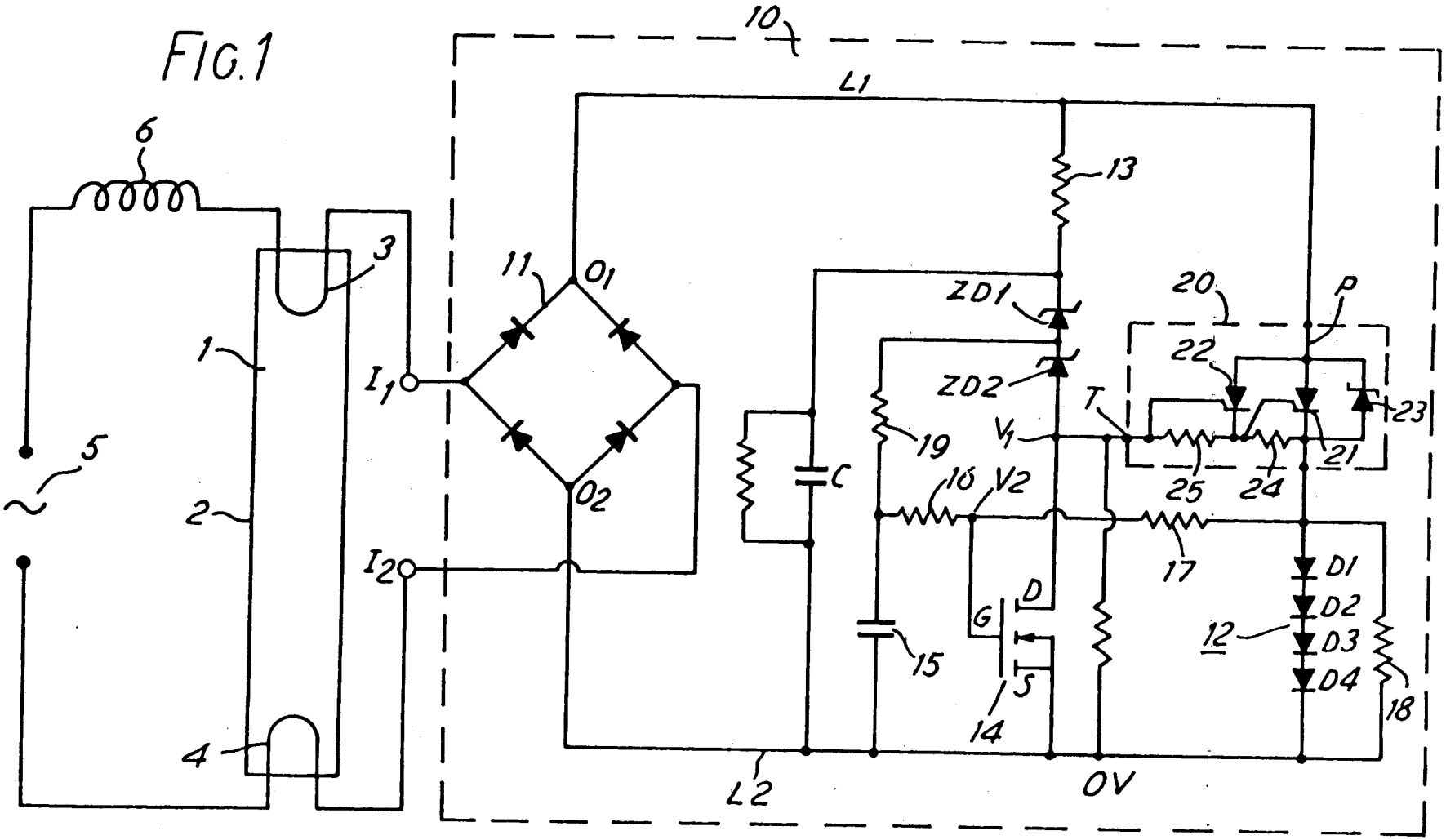

This invention relates to starter circuits for discharge lamps, such as a fluorescent discharge lamp or a high pressure discharge lamp, e.g. a high pressure sodium discharge lamp or a high pressure metal halide discharge lamp.

A fluorescent discharge lamp comprises a tubular, glass envelope containing a gas and having a cathode heater at either end. Light is produced in the lamp by means of an electrical discharge in the gas which excites a phosphor coating on the envelope.

In operation, the lamp presents a negative electrical impedance and so the lamp is connected to an alternating voltage supply by means of a reactive (typically an inductive) ballast. In general, the lamp "running" voltage is some 20 to 60 per cent of the nominal supply voltage, the remainder of the supply voltage being dropped across the ballast.

In order to start the lamp it is conventional to provide a starter circuit, which is connected between the cathode heaters and is effective to create a high voltage striking pulse across the lamp. Starting is assisted if a heating current is applied to the cathode heaters prior to application of the striking pulse, the cathode heaters, when hot, providing a source of ions and electrons for the discharge, thereby reducing the magnitude of the voltage pulse needed to strike the lamp. It is therefore a function of a starter circuit, suitable for use with a fluorescent discharge lamp, to provide an initial "pre-heat" period, during which a heating current is applied to the cathode heaters, followed by one or more high voltage striking pulses.

A known, electro-mechanical starter circuit, commonly referred to as a "glow starter", incorporates a bi-metal switch. This circuit tends to operate erratically, and can give rise to disturbing, intermittent flashes during starting until the lamp has finally struck. Moreover, the circuit components tend to be bulky, and are not suited to automated, or semi-automated, assembly procedures.

European Patent Application No. 0118309 describes another kind of starter circuit suitable for use with fluorescent discharge lamps. While the circuits described in this document alleviate many of the short-comings of the "glow starter", they suffer from the disadvantage that they produce a single striking pulse only, or a single striking pulse during each half-cycle of the supply voltage, and so these starter circuits tend to require a relatively long pre-heat period, lasting typically two seconds or more.

In European Patent Application No. 0249485 there is described a discharge lamp starter circuit in which several striking pulses are produced during each half-cycle of the supply voltage. The circuit used to produce the pulses is, however, relatively complex.

It is an object of the present invention to provide a starter circuit which comprises relatively few components and which alleviates some, at least, of the aforementioned problems.

Accordingly there is provided a starter circuit suitable for a discharge lamp which is connected to an alternating voltage supply by means of a reactive ballast, the starter circuit comprising a rectifier for connecting the lamp to first and second voltage supply lines; at least one diode; a current control circuit having a controlled current path connected in series with said at least one diode between the voltage supply lines, the current control circuit being arranged to control flow of current in said controlled current path in dependence on a first control voltage applied at a control terminal of the current control circuit, whereby, in operation, the controlled current path can present a relatively high impedance, preventing a flow of current in said path, and a relatively low impedance, allowing a flow of current in said path; means for deriving from the rectified supply a predetermined said control voltage commensurate with said relatively low impedance condition and a field effect transistor arranged to modify said predetermined control voltage in dependence on a further control voltage applied to the gate electrode of the field effect transistor, thereby to initiate a transition from said low to said high impedance condition and cause a high voltage striking pulse to be applied across the lamp, said further control voltage being dependent on a voltage at the junction of said at least one diode and said controlled current path, whereby the starting circuit, in operation, is effective to enable a succession of striking pulses during a single half cycle of the rectified supply.

The inventor has found that a multi-pulse starter circuit as defined in the immediately preceding paragraph, that is a starter circuit capable of producing a succession of pulses during a single half-cycle of the rectified supply, is remarkably effective in starting both fluorescent and high pressure discharge lamps.

In the case of a starter circuit suitable for use with a fluorescent discharge lamp having cathode heaters, the rectified circuit is arranged to connect the cathode heaters to said first and second voltage supply lines and the starter circuit further includes a capacitor connected, via a resistor, both to said gate electrode of the field effect transistor and to said junction, the arrangement being effective to initiate a first striking pulse when current has been flowing in said controlled current path for a pre-determined, preheat interval. Said succession of pulses may include said first striking pulse.

The inventor finds that the starting performance of the starter circuit is more reliable than that of a conventional "glow" starter, especially with relatively long lamps (6–8 ft. long, say), and requires a relatively short pre-heat period (typically about 0.8 seconds, for example). The starter circuit is also found to exhibit excellent re-strike characteristics.

The capacitor may be coupled to a said supply line in order to inhibit creation of further striking pulses in the event that the lamp has not struck within a predetermined interval of time.

In another embodiment of the invention a starter circuit suitable for use with a high pressure discharge lamp includes electrically resistive means (a potential divider, for example) coupling said gate electrode of the field effect transistor to said junction.

Starter circuits in accordance with the present invention may be embodied as a relatively compact package. In this regard, it has been found, for example, that since the field effect transistor has a relatively high input impedance it is possible to use a relatively small value charging capacitor (in the range from 3 microfarad to 7 microfarad for example), such capacitors being relatively small in size, and being well suited to automated assembly techniques, particularly surface mount techniques.

Figure 2:
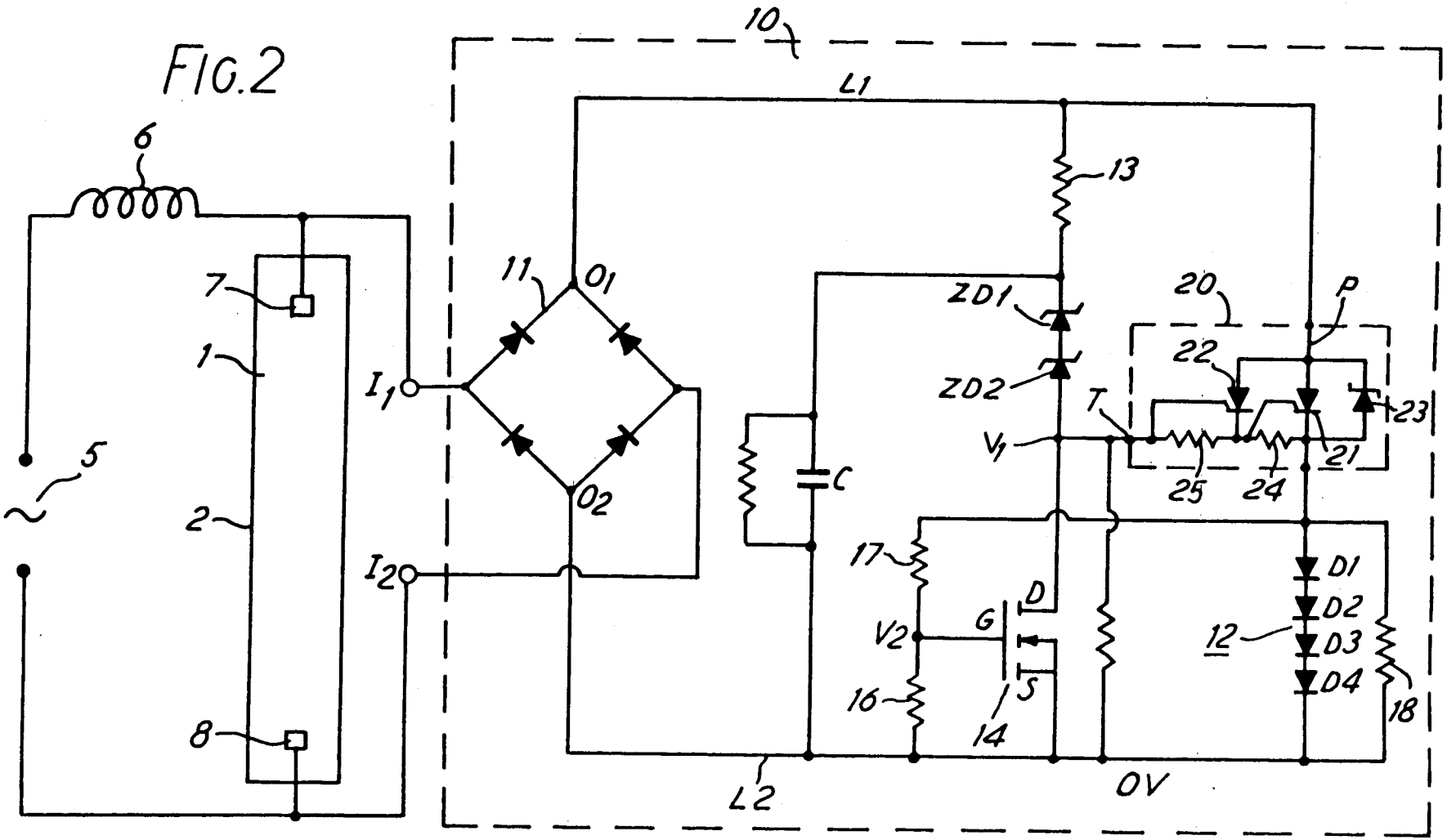

In order that the invention may be carried readily into effect embodiments thereof are now described, by way of example only, by reference to the accompanying drawings of which:

FIG. 1 shows a starter circuit suitable for use with a fluorescent discharge lamp, and FIG. 2 shows another starter circuit suitable for use with a high pressure discharge lamp.

Referring now to FIG. 1, a fluorescent lamp 1 comprises a tubular, quartz envelope 2 having a pair of cathode heaters 3, 4, one at each end of the envelope. The lamp is connected, as shown, to a supply 5 of alternating voltage, typically a 50 Hz mains supply, and one of the cathode heaters 3 is connected to the voltage supply by means of an inductive ballast 6.

A starter circuit, in accordance with the present invention, is shown generally at 10. The starter circuit comprises a full wave rectifier circuit 11 having first and second input terminals $I_1$, $I_2$, each connected to a respective one of the cathode heaters, and first and second output terminals $O_1$, $O_2$, each connected to a respective voltage supply line $L_1$, $L_2$. The starter circuit also includes a current control circuit, shown generally at 20, and a series arrangement 12 of diodes D1, . . . D4 (in this example, four diodes are used). As will be described in greater detail hereinafter, the current control circuit 20 has a controlled current path P connected in series with the diode arrangement 12 between the voltage supply lines $L_1$, $L_2$.

In this example, the current control circuit 20 is of the form described in European Patent Application No. 0118,309, and is referred to in that document as a "fluoractor". The "fluoractor" comprises a first thyristor 21 defining the controlled current path P and a second thyristor 22 which, in association with resistors 25, 24, cooperates with thyristor 21 to control a flow of current in path P in dependence on the magnitude of a control voltage $V_1$ applied at a control (gate) terminal T of the "fluoractor". The control terminal is connected to the (positive) supply line $L_1$ via the series arrangement of a first Zener diode ZD1, a second Zener diode ZD2 and a resistor 13, and is connected to the other (zero volts) supply line $L_2$ via the drain-source path of a field effect transistor 14. After the alternating supply 5 has been turned on, a control voltage $V_1$ will appear at terminal T when the rectified voltage on line $L_1$ exceeds the combined breakdown voltages of the Zener diode pair ZDl, ZD2. When the control voltage attains a threshold value (typically 3 V) the "fluoractor" is "turned on", causing the controlled current path P to become conductive. This establishes a cathode heating current in the circuit, the voltage across the output terminals of the rectifier circuit falling to the combined forward voltage drops of the "fluoractor" (typically 2–3 V) and of the diode arrangement (typically 2.8 V i.e. 0.7 V for each diode).

The forward voltage drop across the diode arrangement is effective to slowly charge a capacitor 15 through a pair of resistors 16, 17 which are connected together in series. A second control voltage $V_2$, which appears at the junction of resistors 16 and 17 and is applied to the gate electrode G of the field effect transistor 14, depends on the voltage developed across the capacitor and on the forward voltage drop across the diode arrangement. After a predetermined, pre-heat interval, determined mainly by the time constant of the capacitor-resistor charging circuit (15, 16, 17), voltage $V_2$ attains the gate-source threshold voltage (typically about 2 V) of the field effect transistor, causing the drain-source path of the transistor to become conductive, and biassing the control terminal T of the "fluoractor" progressively more negative with respect to the cathode of thyristor 21. In consequence, the "fluoractor" is "turned-off" and the controlled current path P ceases to conduct as soon as the pre-heat current falls below the holding current (typically about 175 mA) of thyristor 21, the resulting interruption of pre-heat current giving rise to a high-voltage, back-emf, striking pulse across the lamp. The striking pulse has an amplitude (typically 1–1.5 kV) which is limited by a Zener diode 23 connected across thyristor 21, and is of a duration determined by the stored energy in the inductive ballast 6. The above-referenced European patent application describes in detail how the duration of the striking pulse may be evaluated.

When conduction in the controlled current path P of the "fluoractor" ceases, the forward voltage drop across diode arrangement 12 disappears, the voltage at the cathode of thyristor 21 being clamped to the voltage (OV) on supply line $L_2$ by means of a resistor 18 which is connected across the diode arrangement and has a resistance value much smaller than have resistors 16 and 17.

As will be described in great detail hereinafter the voltage across capacitor 15 is increasing exponentially, but very slowly. However, the sudden disappearance of the forward voltage drop across the diode arrangement 12 does affect the control voltage $V_2$ causing its value to fall below the gate-source threshold voltage of the field effect transistor and rendering the drain-source path of the transistor non-conductive. The control voltage at T can then rise, turning the "fluoractor" back on and restoring a flow of current in path P. The forward voltage drop then re-appears across the diode arrangement causing control voltage $V_2$ to rise above the gate-source threshold of the field effect transistor, whereupon the drain-source path of the transistor becomes conductive again, initiating a further striking pulse.

This sequence may be repeated many times (e.g. as many as 20–30 times) during a single half-cycle of the rectified supply, each sequence giving rise to a respective striking pulse. The starter circuit is capable, therefore, of producing a large number of striking pulses in rapid succession, typically at a frequency of between 1 and 5 kHz, and striking pulses may be produced during successive half-cycles of the rectified supply until the lamp has struck. The inventor finds that a multi-pulse starter circuit in accordance with the invention is remarkably effective since the pre-heat interval can be much shorter (typically about 0.8 second) than that needed in hitherto known starter circuits of the kind which produce a single pulse only during each half cycle of the supply, such known circuits usually requiring a pre-heat interval of 2 seconds or more. Moreover, the inventor finds that a starter circuit in accordance with this invention is especially effective in starting relatively long lamps (6–8 ft. long say), which are normally difficult to start, and has good reset characteristics enabling the starter circuit to successfully re-strike a lamp following a short interruption of the mains supply.

If the lamp should strike (and this could happen in response to the first striking pulse) the voltage across the lamp falls to the normal running voltage. The circuit may be arranged so that the combined breakdown voltage of the Zener diodes ZD1, ZD2 exceeds the normal running voltage thereby preventing occurrence of further pulses and allowing capacitor 15 to discharge in readiness for a possible mains interruption, whereupon the starting sequence would recommence.

An additional capacitor C is provided to filter out spurious, high-voltage spikes which could occur in the rectified supply and might otherwise give rise to unwanted striking pulses.

The circuit shown in FIG. 1 is arranged so that if the lamp fails to strike within a preset interval of time (1 to 2 seconds, say), further pulsing is inhibited. To that end capacitor 15 is charged slowly via a resistor 19 connected to the junction of the two Zener diodes. The voltage across the capacitor eventually reaches such a high value that control voltage $V_2$ is always greater than the gate-source threshold voltage of the field effect transistor, regardless of any change in the forward voltage drop across the diode arrangement, thereby ensuring that the drain-source path is permanently conductive and preventing the creation of further striking pulses until such time as the alternating supply is disconnected and then re-connected.

Although the starter circuit shown in FIG. 1 is intended principally for use with a fluorescent discharge lamp, the inventor finds that the circuit may also be used to strike a high pressure discharge lamp, such as a high pressure sodium or a metal halide discharge lamp. Clearly a specific, pre-heat period would not be needed in that case and so the capacitor-resistor network (15, 16, 17) may be arranged to provide as small a delay as is practicable.

FIG. 2 of the drawings shows an alternative starter circuit, in accordance with the invention, which is better suited for use with a high pressure discharge lamp.

The starter circuit shown in FIG. 2 is similar to that shown in FIG. 1, like components being ascribed like reference numerals. A high pressure discharge lamp does not, of course, have cathode heaters; in contrast a single discharge electrode (7, 8) is provided at each end of the lamp. In this embodiment, the starter circuit does not provide an initial pre-heat period, capacitor 15 being replaced by a short-circuit and control voltage $V_2$, applied at gate electrode G of the field effect transistor 14, being derived by means of the potential divider formed by resistors 16, 17. Resistor 19 is also omitted. As in the case of the circuit shown in FIG. 1, control voltage $V_2$, at gate G, rises above, and falls below, the gate-source threshold voltage of the field effect transistor repeatedly, in response to the appearance, and disappearance, of forward voltage drop across the series diode arrangement 12 enabling, as before, a succession of striking pulses during a single half cycle of the rectified supply.

The starter circuits in accordance with the present invention can be embodied using circuit components which are relatively small in size. The current control circuit may be fabricated as a monolithic, semiconductor device, for example a "fluoractor", as described in the afore-mentioned European Patent application, and the field effect transistor may comprise a small-signal MOSFET having a gate-source threshold voltage typically in the range 0.8 V to 3 V, and preferably about 2 V. Furthermore, since the field effect transistor has a relatively high input impedance, resistors 16 and 17 may have relatively high resistance values so that capacitor 15 may have a relatively small capacitance (typically about 4.7 microfarod for example). Such capacitors are relatively small in size and are well suited to automated assembly techniques, especially surface mount techniques.

It will be appreciated that although the examples described by reference to FIGS. 1 and 2 include a full-wave rectifier circuit, it is alternatively possible to use a half-wave rectifier circuit.

What we claim is:

1. A starter circuit suitable for a discharge lamp which is connected to an alternating voltage supply by means of a reactive ballast, the starter circuit comprising a rectifier for connecting the lamp to first and second voltage supply lines; at least one diode; a current control circuit having a controlled current path connected in series with said at least one diode between the voltage supply lines, the current control circuit being arranged to control flow of current in said controlled current path in dependence on a first control voltage applied at a control terminal of the current control circuit, whereby, in operation, the controlled current path can be triggered into a non-conducting state to present a relatively high impedance, preventing a flow of current in said path, and can be triggered into a conducting state to present a relatively low impedance, allowing a flow of current in said path; means for deriving from the rectified supply a predetermined said control voltage to trigger said current control circuit into said conducting state and a field effect transistor arranged to modify said predetermined control voltage in dependence on a further control voltage applied to the gate electrode of said field effect transistor, to trigger said current control circuit into said non-conducting state and cause a high voltage striking pulse to be applied across the lamp, said further control voltage being dependent on a voltage at a junction between said at least one diode and said controlled current path, whereby the starting circuit, in operation, triggers said controlled current path into its conducting an non-conducting state a plurality of times during a half cycle of applied alternating voltage to provide a succession of said high voltage striking pulses across said discharge lamp during a single half cycle of the rectified supply thereby assisting the starting of said lamp.

2. A starter circuit according to claim 1 suitable for use with a fluorescent discharge lamp which has cathode heaters, wherein said rectifier circuit is arranged to connect the cathode heaters to said first and second voltage supply lines and the starter circuit includes a capacitor connected, via a resistor, to said gate electrode and to said junction between said at least one diode and said controlled current path, the arrangement being effective to initiate a first striking pulse when current has been flowing in said controlled current path for the duration of a pre-determined, pre-heat interval.

3. A starter circuit according to claim 2 wherein said succession of striking pulses includes said first striking pulse.

4. A starter circuit according to claim 2 wherein the capacitor is coupled to a said supply line to inhibit creation of striking pulses after a predetermined interval of time measured from supply of said alternating voltage.

5. A starter circuit according to claim 2 wherein said capacitor has a capacitance in the range from 3 microfarad to 7 microfarad.

6. A starter circuit according to claim 1 suitable for use with a high pressure discharge lamp, the starter circuit including electrically resistive means coupling the gate electrode of the field effect transistor to said junction between said at least one diode and said controlled current path.

7. A starter circuit according to claim 6 wherein said electrically resistive means is a potential divider.

8. A starter circuit according to claim 1 wherein the means for deriving said first control voltage includes a voltage limiting device connected between said control terminal and one of said first and second voltage supply lines.

9. A starter circuit according to claim 8 wherein the voltage limiting device is arranged to inhibit production of further striking pulses when the lamp is running.

10. A starter circuit according to claim 8 wherein the voltage limiting device is a Zener diode.

11. A starter circuit according to claims 8 wherein the drain source path of said field effect transistor is connected between said control terminal and the other of said first and second voltage supply lines.

12. A starter circuit according to claim 1 wherein said current control circuit includes a thyristor which defines said controlled current path.

* * * * *